US010436529B1

(12) United States Patent
Holley, Jr.

(10) Patent No.: US 10,436,529 B1
(45) Date of Patent: Oct. 8, 2019

(54) HYDRAULIC FLUID COOLERS

(71) Applicant: William T. Holley, Jr., Tenaha, TX (US)

(72) Inventor: William T. Holley, Jr., Tenaha, TX (US)

( * ) Notice: Subject to any disclaimer, the term of this patent is extended or adjusted under 35 U.S.C. 154(b) by 0 days.

(21) Appl. No.: 16/109,941

(22) Filed: Aug. 23, 2018

(51) Int. Cl.
*F28F 27/00* (2006.01)
*F28D 1/02* (2006.01)

(52) U.S. Cl.
CPC ..... *F28F 27/00* (2013.01); *F28D 1/024* (2013.01); *F28F 2250/08* (2013.01); *F28F 2265/12* (2013.01)

(58) Field of Classification Search
CPC .... F28F 27/00; F28F 2250/08; F28F 2265/12; F28D 1/024
USPC ..... 165/281
See application file for complete search history.

(56) References Cited

U.S. PATENT DOCUMENTS 1,306,976 A * 6/1919 Searles ..... H01L 23/467 123/41.48
1,576,833 A * 3/1926 Larsen ..... F28D 1/0535 165/122
2,330,653 A * 9/1943 Wilson ..... F28D 1/024 165/122
2,399,487 A * 4/1946 Hartwig ..... F28D 1/024 165/124
3,101,930 A * 8/1963 Huet ..... F28D 7/10 165/143
3,411,316 A * 11/1968 Wright ..... B60H 1/3227 62/239
4,063,431 A * 12/1977 Dankowski ..... B60H 1/3227 123/196 AB
4,190,105 A * 2/1980 Dankowski ..... B60H 1/3227 138/38
4,955,585 A 9/1990 Dickerson
5,121,788 A * 6/1992 Carollo ..... B23K 37/003 165/104.31
5,224,446 A 7/1993 Okita et al.
6,092,378 A * 7/2000 Das ..... F25B 13/00 62/186
7,909,585 B2 3/2011 Clancy
8,042,333 B2 10/2011 Friesen
8,539,723 B2 9/2013 Ramsey et al.
9,217,447 B2 12/2015 Dybing
(Continued)

*Primary Examiner* — Raheena R Malik
(74) *Attorney, Agent, or Firm* — R. Keith Harrison

(57) ABSTRACT

Hydraulic fluid coolers suitable for cooling hydraulic fluid in a closed loop hydraulic circuit and capable of withstanding high hydraulic fluid pressures may include at least one heat exchanger. The at least one heat exchanger may include a header assembly having a header inlet conduit, a header outlet conduit and a fan motor outlet conduit. A plurality of primary cooling conduits may be disposed in fluid communication with and extend between the header inlet conduit and the header outlet conduit. A plurality of secondary cooling conduits may be disposed in fluid communication with and extend between the header inlet conduit and the fan motor outlet conduit. A cooling fan may be disposed adjacent to the plurality of primary cooling conduits and the plurality of secondary cooling conduits. A hydraulically-actuated cooling fan motor may drivingly engage the cooling fan. The cooling fan motor may be disposed in fluid communication with the fan motor outlet conduit of the header assembly.

20 Claims, 13 Drawing Sheets

(56) References Cited

U.S. PATENT DOCUMENTS

| | | | | |
|---|---|---|---|---|
| 9,631,378 | B1 | 4/2017 | Grahl et al. | |
| 9,752,833 | B2 * | 9/2017 | Gao | F25B 39/02 |
| 2007/0074515 | A1 | 4/2007 | Yoshino | |
| 2013/0213633 | A1 * | 8/2013 | Emminger | F01M 5/002 165/281 |
| 2013/0306300 | A1 * | 11/2013 | Welsch | F01P 7/048 165/287 |
| 2014/0083106 | A1 * | 3/2014 | Mackin | F28F 3/025 60/772 |
| 2014/0231093 | A1 | 8/2014 | Hoell | |
| 2016/0208819 | A1 * | 7/2016 | Pal | F04D 29/5806 |
| 2016/0223224 | A1 * | 8/2016 | Iwama | F24H 3/087 |
| 2016/0251946 | A1 | 9/2016 | Farshori et al. | |
| 2017/0298703 | A1 | 10/2017 | Ross et al. | |

* cited by examiner

HYDRAULIC FLUID COOLERS

FIELD

Illustrative embodiments of the disclosure generally relate to hydraulic fluid coolers for hydraulic systems. More particularly, illustrative embodiments of the disclosure relate to hydraulic fluid coolers which are suitable for cooling hydraulic fluid in a closed loop hydraulic circuit and capable of withstanding high hydraulic fluid pressures.

SUMMARY

Illustrative embodiments of the disclosure are generally directed to hydraulic fluid coolers which are suitable for cooling hydraulic fluid in a closed loop hydraulic circuit and capable of withstanding high hydraulic fluid pressures. An illustrative embodiment of the hydraulic fluid coolers may include at least one heat exchanger. The at least one heat exchanger may include a header assembly having a header inlet conduit, a header outlet conduit and a fan motor outlet conduit. A plurality of primary cooling conduits may be disposed in fluid communication with and extend between the header inlet conduit and the header outlet conduit. A plurality of secondary cooling conduits may be disposed in fluid communication with and extend between the header inlet conduit and the fan motor outlet conduit. A cooling fan may be disposed adjacent to the plurality of primary cooling conduits and the plurality of secondary cooling conduits. A hydraulically-actuated cooling fan motor may drivingly engage the cooling fan. The cooling fan motor may be disposed in fluid communication with the fan motor outlet conduit of the header assembly.

BRIEF DESCRIPTION OF THE DRAWINGS

Illustrative embodiments of the disclosure will now be described, by way of example, with reference to the accompanying drawings, wherein.

DETAILED DESCRIPTION

Figure 1:
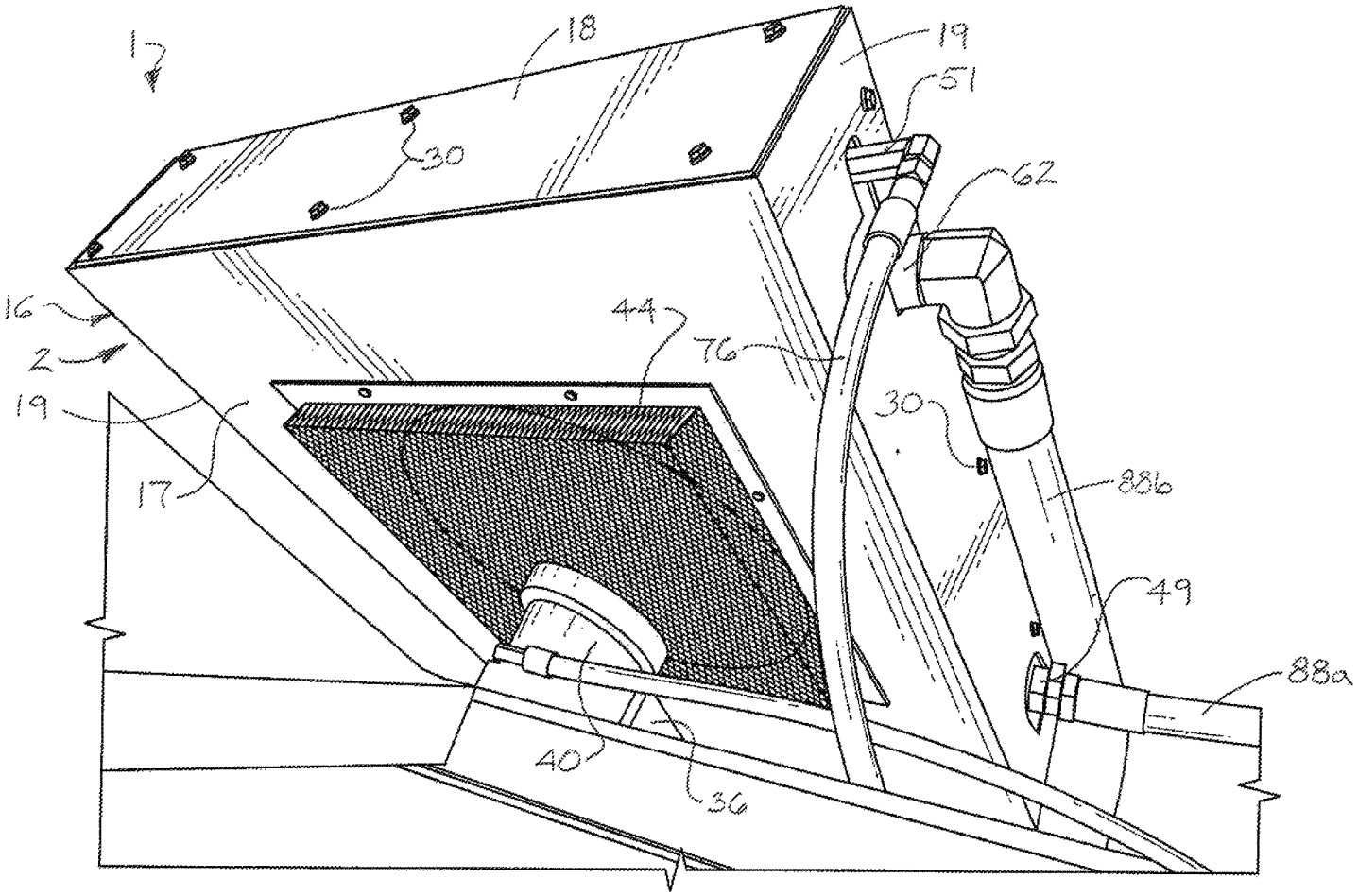
FIG. 1 is a front perspective view of an illustrative embodiment of the hydraulic fluid coolers.
Figure 2:
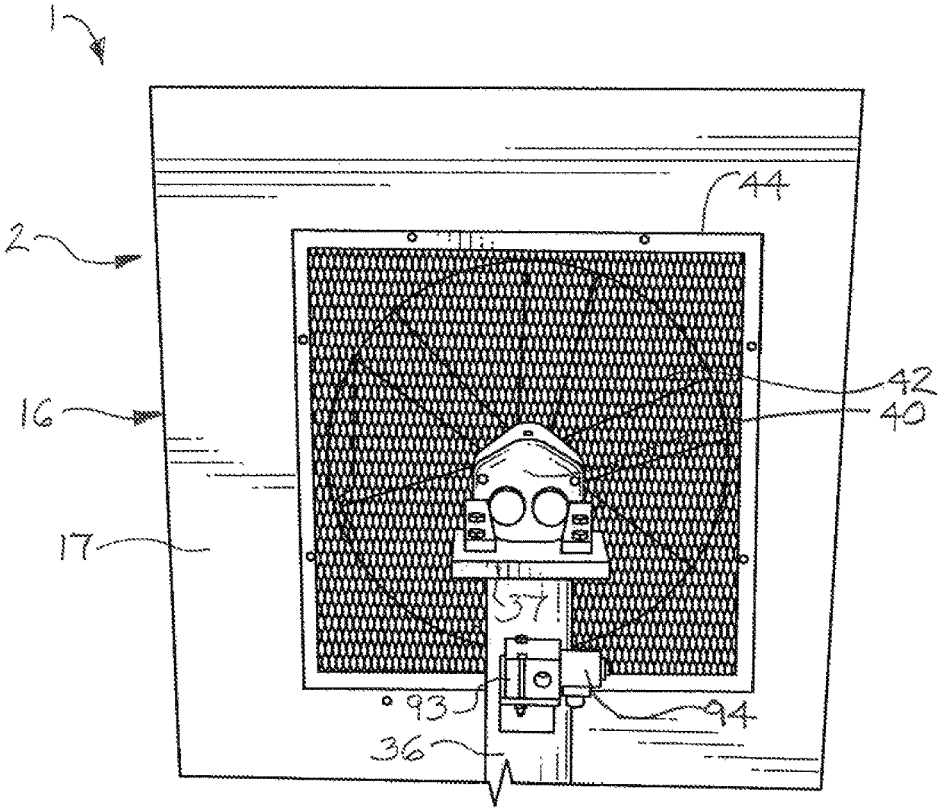
FIG. 2 is a front view of the illustrative hydraulic fluid cooler.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear". "right", "front". "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 17:
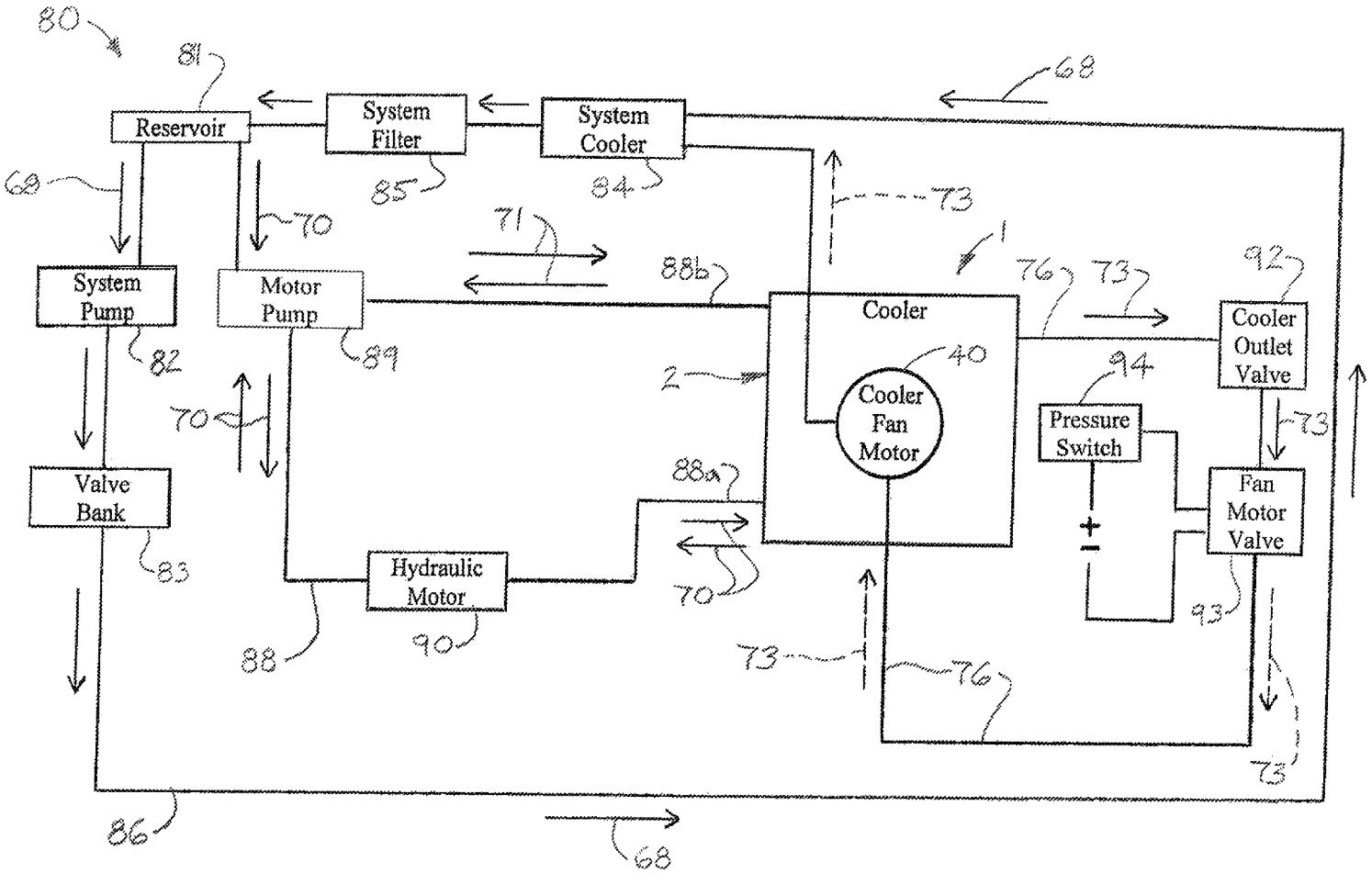
FIG. 17 is a schematic block diagram of a typical closed loop hydraulic system in typical implementation of the hydraulic fluid cooler.

Referring initially to FIG. 17 of the drawings, an illustrative embodiment of the hydraulic fluid coolers is generally indicated by reference numeral 1. As will be hereinafter further described, in some applications, the hydraulic fluid cooler 1 may be installed in a closed loop hydraulic system 80. The closed loop hydraulic system 80 may include a main loop 86 have a hydraulic fluid reservoir 81. The hydraulic fluid reservoir 81 may be suitably sized and configured to contain a supply of hydraulic oil or fluid. A system pump 82 may be provided in fluid communication with the reservoir 81. In some applications, the system pump 82 may include a fixed displacement pump. A valve bank 83 may be provided in fluid communication with the system pump 82. The valve bank 83 may include 3-position spring center valves. A system heat exchanger or cooler 84 may be provided in fluid communication with the valve bank 83. A system filter 85 may be provided in fluid communication with and between the system cooler 84 and the hydraulic fluid reservoir 81. Accordingly, the hydraulic fluid reservoir 81, the system pump 82, the valve bank 83, the system cooler 84 and the system filter 85 may form the main loop 86 of the closed loop hydraulic system 80.

A motor actuating loop 88 may include a motor pump 89 provided in fluid communication with the hydraulic fluid reservoir 81. In some applications, the motor pump 89 may include variable displacement over center pump with pressure compensation. The motor pump 89 may include a charge pump (not illustrated) which maintains the hydraulic pressure of a motor hydraulic fluid stream 70 in the motor actuating loop 88 at a predetermined hydraulic fluid charge pressure. A hydraulic motor 90 may be provided in fluid communication with the motor pump 89. The hydraulic fluid cooler 1 may be provided in fluid communication with the hydraulic motor 90 and the motor pump 89. In some applications, the hydraulic motor 90 may include a fixed displacement bidirectional piston motor. In some applications, the hydraulic motor 90 may rotate a cable spool 110 (FIG. 18) on a swab unit 100, for example and without limitation. It will be recognized and understood, however, that the hydraulic motor 90 may have any of a variety of other applications in the closed loop hydraulic system 80.

The hydraulic fluid cooler 1 may have a cooler fan motor 40 which drivingly engages and rotates a cooling fan 42 (FIGS. 13 and 14), as will be hereinafter further described. A fan motor loop 76 may include a cooler outlet valve 92 provided in fluid communication with the cooler 1. In some applications, the cooler outlet valve 92 may include an orifice valve or a needle valve. A fan motor valve 93 in the fan motor loop 76 may be provided in fluid communication with the cooler outlet valve 92. A pressure switch 94 may functionally interface with the fan motor valve 93. The cooler fan motor 40 of the cooler 1 may be provided in fluid communication with the fan motor valve 93 to complete the fan motor loop 76. The system cooler 84 of the closed loop hydraulic system 80 may be disposed in fluid communication with the cooler fan motor 40.

In some embodiments, the cooler fan motor 40 may be hydraulically-actuated. In other embodiments, the cooler fan motor 40 may include a DC or AC electric motor.

In typical application of the hydraulic fluid cooler 1, which will be hereinafter described, the system pump 82 may pump system hydraulic fluid 68 from the hydraulic fluid reservoir 81 through the valve bank 83, the system cooler 84 and the system filter 85 of the main loop 86, and back into the hydraulic fluid reservoir 81. Simultaneously, the motor pump 89 in the motor actuating loop 88 may pump a motor hydraulic fluid stream 70 from the hydraulic fluid reservoir 81 through the hydraulic motor 90 and the hydraulic fluid cooler 1. The motor hydraulic fluid stream 70 may flow from the hydraulic fluid cooler 1 back to the motor pump 89 and continue to circulate through the motor actuating loop 88. In some applications, the hydraulic motor 90 may be operated in either direction to facilitate bidirectional flow of the motor hydraulic fluid stream 70 through the motor actuating loop 88. The hydraulic fluid cooler 1 may cool the motor hydraulic fluid stream 70 as it flows through the hydraulic fluid cooler 1, as will be hereinafter described.

In some embodiments, the cooler fan motor 40 may include a hydraulically-actuated motor. Accordingly, as the motor hydraulic fluid stream 70 circulates through the motor actuating loop 88, a fan motor hydraulic fluid stream 73 may flow from the hydraulic fluid cooler 1 through the fan motor loop 76 to the cooler fan motor 40 to drive the cooler fan motor 40. Accordingly, the fan motor hydraulic fluid stream 73 may flow through the cooler outlet valve 92, the fan motor valve 93 and the cooler fan motor 40 to drive the cooler fan motor 40 and rotate the cooling fan 42 (FIGS. 13 and 14) inside the hydraulic fluid cooler 1. After it leaves the cooler fan motor 40, the fan motor hydraulic fluid stream 73 may flow through the system cooler 84 and the system filter 85, respectively, and return to the hydraulic fluid reservoir 81 in the main loop 86.

The pressure switch 94 may continually monitor or measure the pressure of the fan motor hydraulic fluid stream 73 as it flows through the fan motor loop 76. In the event that the measured pressure of the fan motor hydraulic fluid stream 73 in the fan motor loop 76 exceeds a predetermined hydraulic fluid charge pressure, such as 300-500 psi, for example and without limitation, the pressure switch 94 may close the fan motor valve 93 to prevent further flow of the fan motor hydraulic fluid stream 73 to the cooler fan motor 40 of the hydraulic fluid cooler 1. Accordingly, termination of the flow of the fan motor hydraulic fluid stream 73 through the cooler fan motor 40 may prevent overspeed of and damage to the cooler fan motor 40 which may otherwise occur in the event of high hydraulic fluid pressures which exceed the predetermined hydraulic fluid charge pressure.

In some embodiments, the cooling fan motor 40 may include a DC or AC electric motor. Accordingly, the fan motor loop 76 may bypass the cooler fan motor 40 and terminate at the system cooler 84. The pressure switch 94 may functionally interface with the cooler fan motor 40 to terminate further operation of the cooler fan motor 40 in the event that the measured pressure of the fan motor hydraulic fluid stream 73 exceeds the predetermined hydraulic fluid charge pressure.

Figure 3:
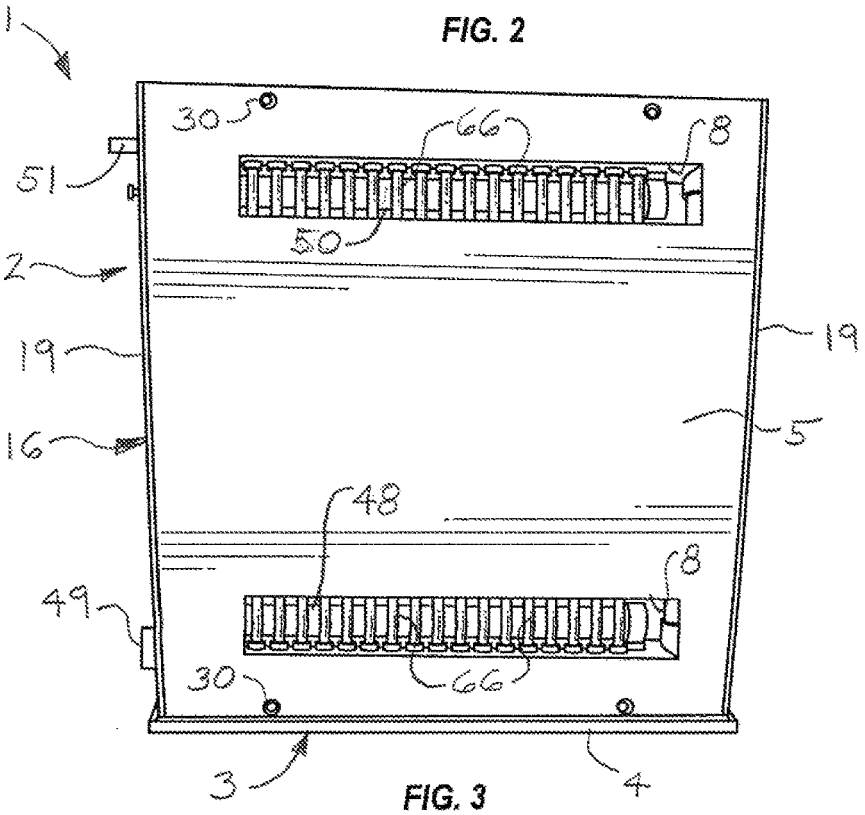
FIG. 3 is a rear view of the illustrative hydraulic fluid cooler.
Figure 4:
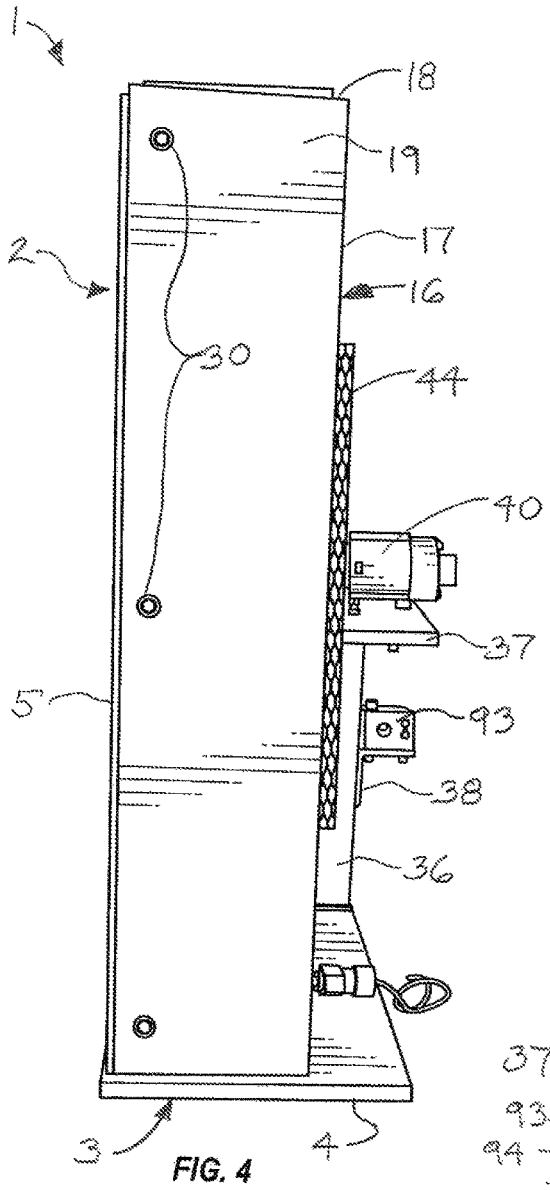
FIG. 4 is a right-side view of the illustrative hydraulic fluid cooler.
Figure 5:
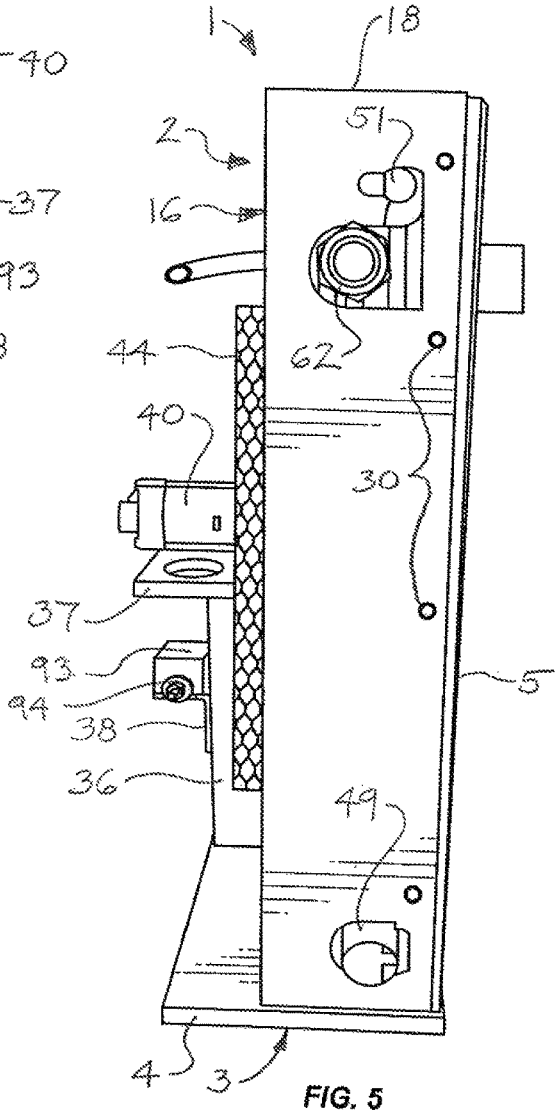
FIG. 5 is a left side view of the illustrative hydraulic fluid cooler.
Figure 13:
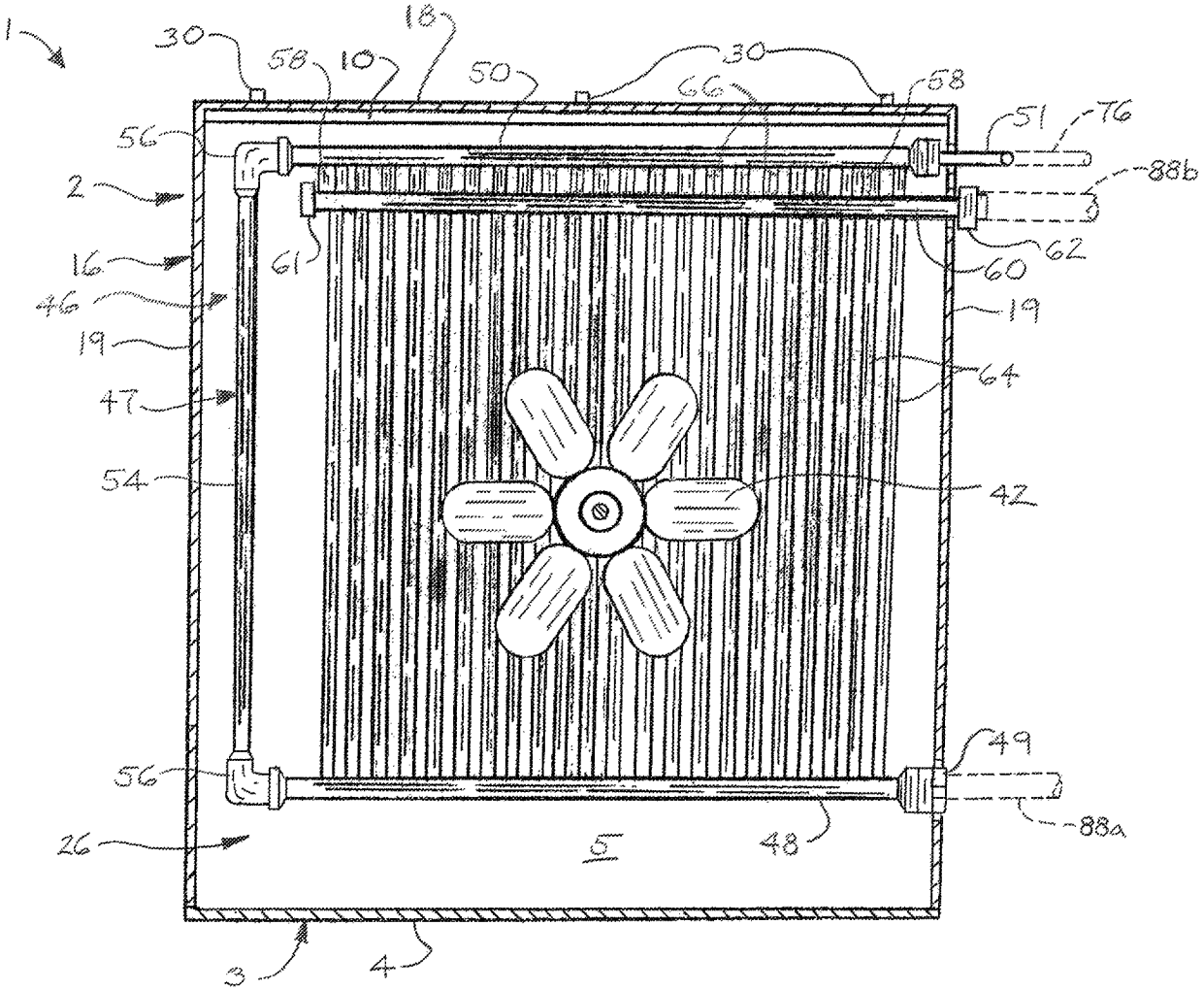
FIG. 13 is a sectional view, taken along section lines 13-13 in FIG. 14, of the illustrative hydraulic fluid cooler, with the heat exchanger situated in the housing interior of the cooler housing.
Figure 14:
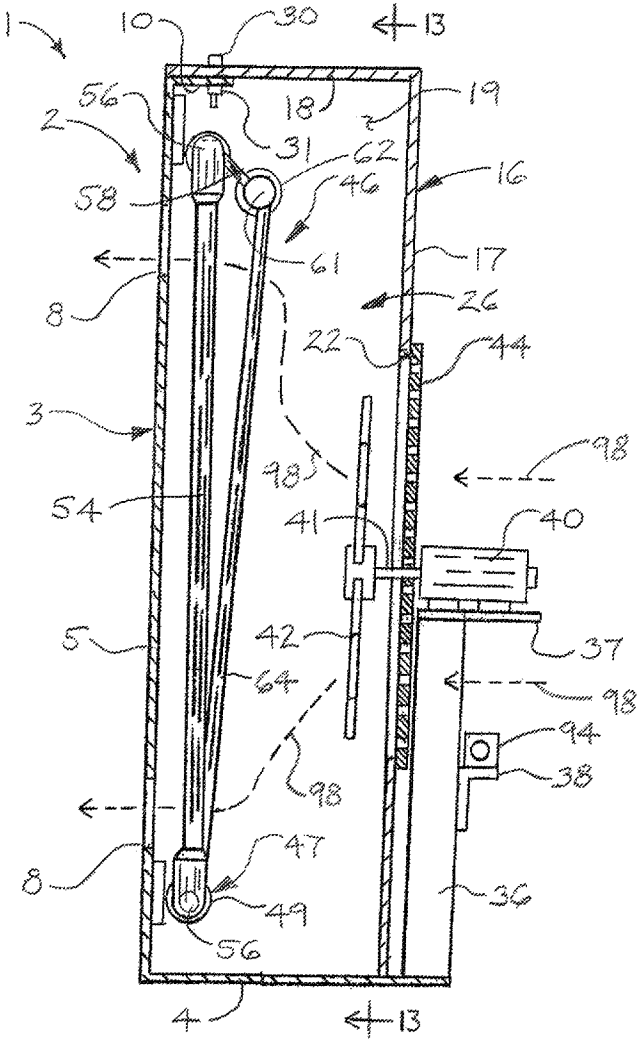
FIG. 14 is a sectional view of the illustrative hydraulic fluid cooler, more particularly illustrating typical flow of air through the housing interior of the cooler housing in typical application of the hydraulic fluid cooler.

Referring next to FIGS. 1-16 of the drawings, the hydraulic fluid cooler 1 may include a cooler housing 2. As particularly illustrated in FIGS. 13 and 14, in some embodiments, the cooler housing 2 may include a housing base 3. The housing base 3 may include a flat base bottom panel 4. A house rear panel 5 may extend upwardly from the base bottom panel 4. As illustrated in FIGS. 3 and 14, at least one housing opening 8 may extend through the base rear panel 5 for purposes which will be hereinafter described. As illustrated in FIG. 14, a base top flange 10 may protrude from an upper edge of the base rear panel 5 parallel to the base bottom panel 4.

A front housing cover 16 may interface with the housing base 3. The front housing cover 16 may include a cover front panel 17. A cover top 18 may extend from an upper edge of the cover front panel 17. A pair of parallel, spaced-apart cover side panels 19 may extend from the cover front panel 17 and the cover of top panel 18. Housing fasteners 30, secured with nuts 31, may mount the front housing cover 16 on the housing base 3. As illustrated in FIGS. 13 and 14, the base bottom panel 4, base rear panel 5, cover front panel 17, cover top panel 18 and cover side panels 19 may together define a housing interior 26. In alternative embodiments, the cooler housing 2 may have alternative designs which are consistent with the functional requirements of the hydraulic fluid cooler 1.

As illustrated in FIG. 14, a fan opening 22 may extend through the cover front panel 17 of the front housing cover 16. As illustrated in FIGS. 1,2, 4, 5 and 14, a fan grill 44 may be attached to the cover front panel 17 over the fan opening 22. The cooler fan motor 40 may drivingly engage the cooling fan 42 through a fan drive shaft 41 (FIG. 14) which extends through the fan opening 22. The cooler fan motor 40 may be mounted on the cooler housing 2 according to the knowledge of those skilled in the art. As illustrated in FIG. 14, in some embodiments, a fan motor pedestal 36 may be mounted on the base bottom panel 4 of the housing base 3 exterior to the cover front panel 17 of the front housing cover 16. A fan motor plate 37 may be provided on the fan motor pedestal 36. The cooler fan motor 40 may be mounted on the fan motor plate 37 using brackets, clips, clamps, mechanical fasteners and/or other mounting technique (not illustrated).

As further illustrated in FIG. 14, in some embodiments, a valve support bracket 38 may be provided on the fan motor pedestal 36. The fan motor valve 93 and/or the pressure switch 94 may be mounted on the valve support bracket 38 according to the knowledge of those skilled in the art.

As further illustrated in FIGS. 13 and 14, at least one heat exchanger 46 may be provided in the housing interior 26 of the cooler housing 2. As illustrated in FIGS. 6-12, in some embodiments the heat exchanger 46 may include at least one header assembly 47. The header assembly 47 may include a header inlet conduit 48. A header inlet coupling 49 may terminate the header inlet conduit 48. A connecting conduit 54 may be disposed in fluid communication with the header inlet conduit 48 through an elbow connector 56. The connecting conduit 54 may be disposed in perpendicular relationship with respect to the header inlet conduit 48. A fan motor outlet conduit 50 may communicate with the connecting conduit 54 through an elbow connector 56. The fan motor outlet conduit 50 may be disposed in perpendicular relationship with respect to the connecting conduit 54 and parallel relationship with respect to the header inlet conduit 48. A hose fitting 51 may extend from the fan motor outlet conduit 50 for purposes which will be hereinafter described. As illustrated in FIG. 3, in some embodiments, a pair of elongated, parallel, spaced-apart, slotted housing openings 8 may extend through the base rear panel 5 on the housing base 3 of the cooler housing 2. The header inlet conduit 48 and the fan motor outlet conduit 50 of the header assembly 47 may align or register with the respective housing openings 8.

The header assembly 47 may further include a header outlet conduit 60. At least one conduit connector 58 may attach or mount the header outlet conduit 60 to the fan motor outlet conduit 50. A conduit cap 61 may close a proximal end of the header outlet conduit 60. A conduit coupling 62 may be disposed in fluid communication with a distal end of the header outlet conduit 60 for purposes which will be hereinafter described.

Figure 6:
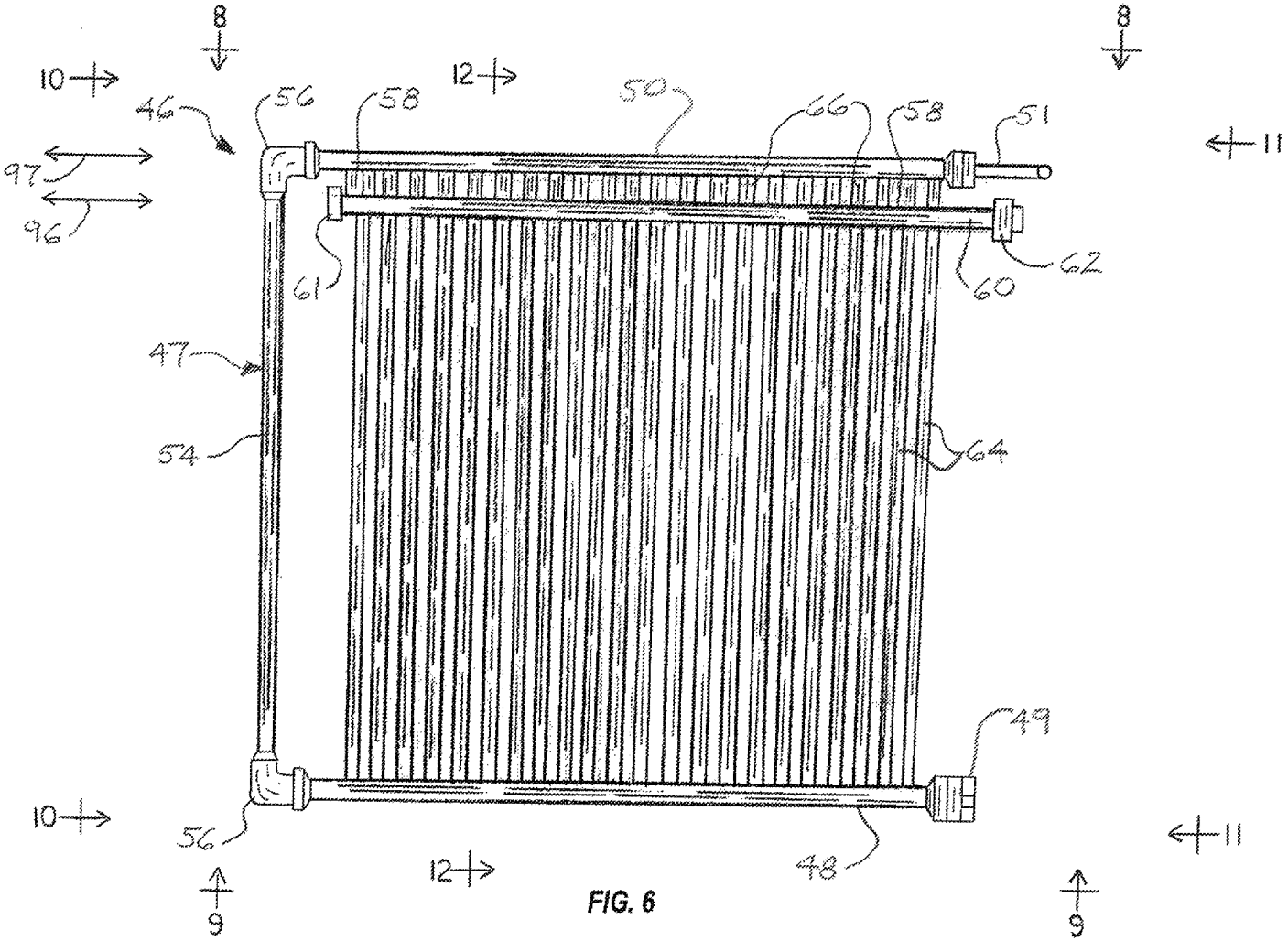
FIG. 6 is a front view of a typical heat exchanger suitable for implementation of the hydraulic fluid coolers.
Figure 7:
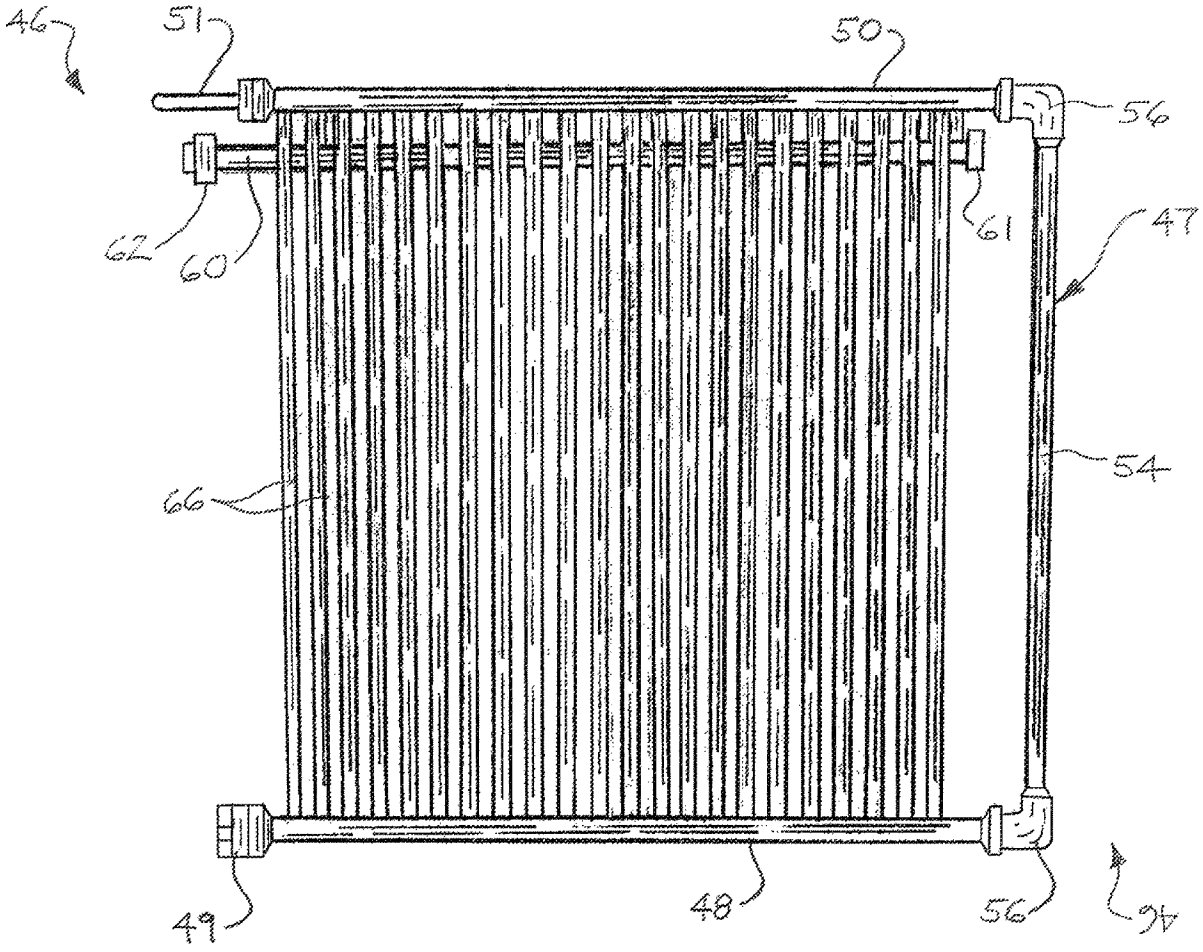
FIG. 7 is a rear view of the heat exchanger illustrated in FIG. 6.
Figure 8:
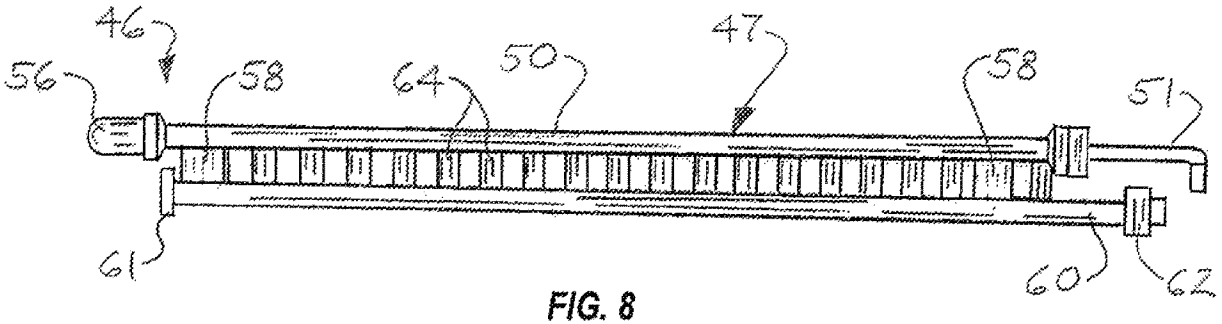
FIG. 8 is a top view of the illustrative heat exchanger, taken along viewing lines 8-8 in FIG. 6.
Figure 9:
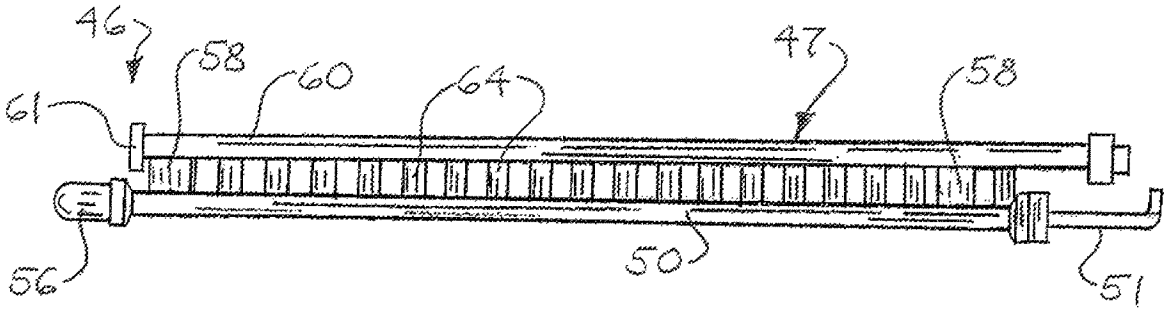
FIG. 9 is a bottom view of the illustrative heat exchanger, taken along viewing lines 9-9 in FIG. 6.
Figure 12:
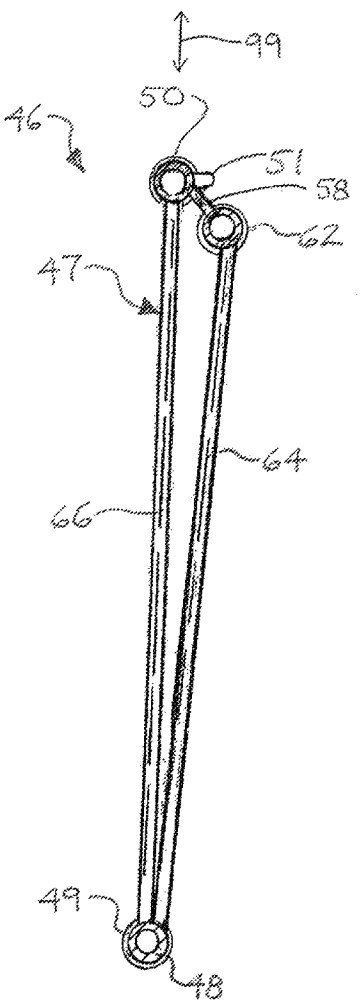
FIG. 12 is a cross-sectional view of the heat exchanger, taken along section lines 12-12 in FIG. 6.
Figure 11:
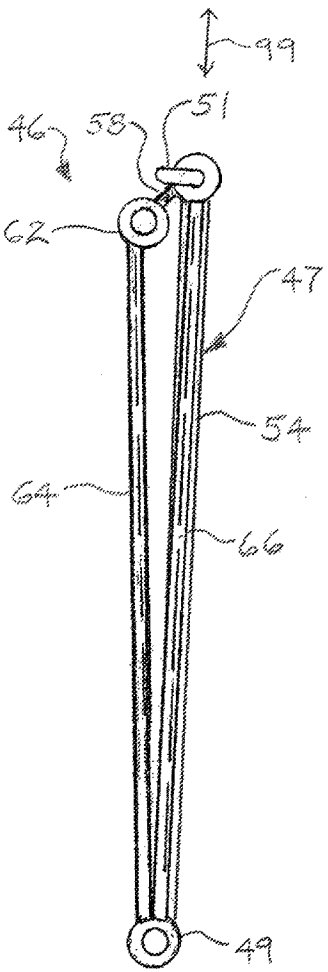
FIG. 11 is a left side view of the heat exchanger, taken along viewing lines 11-11 in FIG. 6.
Figure 10:
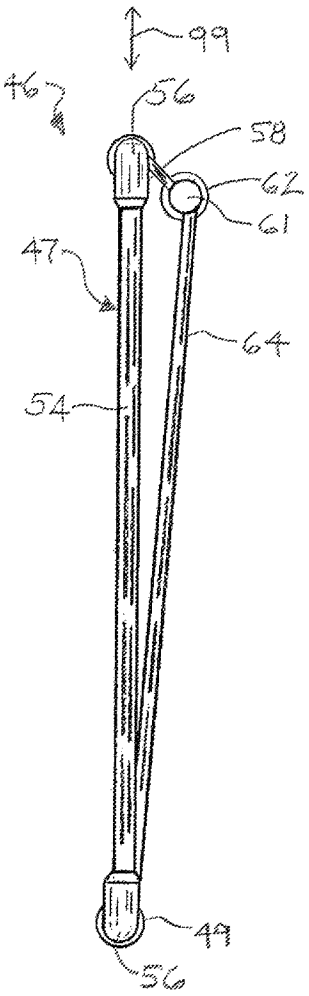
FIG. 10 is a right-side view of the heat exchanger, taken along viewing lines 10-10 in FIG. 6.

In typical operation of the hydraulic fluid cooler 1, which will be hereinafter described, the header inlet conduit 48 and the fan motor outlet conduit 50 of the header assembly 47 may be oriented horizontally, whereas the connecting conduit 54 may be oriented vertically, as illustrated in FIG. 6. The header outlet conduit 60 may be disposed within a first horizontal plane 96, whereas the fan motor outlet conduit 50 may be disposed within a second horizontal plane 97 above and parallel to the first horizontal plane 96. As illustrated in FIGS. 10-12, the header inlet conduit 48, the connecting conduit 54 and the fan motor outlet conduit 50 may be disposed in a common vertical plane 99, whereas the conduit coupling 62 of the header assembly 47 may be disposed outside the vertical plane 99.

A plurality of primary cooling conduits 64 may be disposed in fluid communication with and extend between the header inlet conduit 48 and the header outlet conduit 60 of the header assembly 47. A plurality of secondary cooling conduits 66 may be disposed in fluid communication with and extend between the header inlet conduit 48 and the header outlet conduit 50 of the header assembly 47. As further illustrated in FIGS. 10-12, the primary cooling conduits 64 may be disposed out of the vertical plane 99 within which the header inlet conduit 48, the connecting conduit 54 and the fan motor outlet conduit 50 are deployed, whereas the secondary cooling conduits 66 may be disposed within the vertical plane 99.

In some embodiments, the header inlet conduit 48, the connecting conduit 54, the fan motor outlet conduit 50 and the header outlet conduit 60 of the header assembly 47 and the primary cooling conduits 64 and the secondary cooling conduits 66 may be fabricated of 316L stainless steel schedule 80 pipes. Accordingly, the heat exchanger 46 may be capable of withstanding hydraulic pressures of greater than 300-500 psi. The header inlet conduit 48, the connecting conduit 54, the fan motor outlet conduit 50 and the header outlet conduit 60 of the header assembly 47 may have the same size or diameter of the header inlet coupling 49, the conduit coupling 62 and the hydraulic hoses of the motor actuating loop 88. In some embodiments, the primary cooling conduits 64 and the secondary cooling conduits 66 may be ⅜ inch in diameter, although this dimension may vary depending on the size and particular application of the hydraulic fluid cooler 1. The combined areas of the primary cooling conduits 64 and secondary cooling conduits 66 may exceed the combined areas of the header inlet conduit 48, the connecting conduit 54, the fan motor outlet conduit 50 and the header outlet conduit 60 of the header assembly 47.

Referring again to FIG. 17, the motor actuating loop 88 of the closed loop hydraulic system 80 may include an inlet segment **88*a* and an outlet segment 88*b*. As illustrated in FIG. 13, the inlet segment 88*a* may be disposed in fluid communication with the header inlet conduit 48 of the header assembly 47, typically through the header inlet coupling 49. The outlet segment 88*b* may be disposed in fluid communication with the header outlet conduit 60 of the header assembly 47 typically through the conduit coupling 62. As further illustrated in FIG. 13, the fan motor loop 76 of the closed loop hydraulic system 80 may be disposed in fluid communication with the fan motor outlet conduit 50 of the header assembly 47 typically through the hose fitting 51**.

As illustrated in FIGS. 13 and 14, in the assembled hydraulic fluid cooler 1, the cooling fan 42 may be disposed adjacent or in proximity to the primary cooling conduits 64 of the heat exchanger 46. Accordingly, operation of the cooler fan motor 40 may draw air 98 from outside the cooler housing 2 through the fan grill 44 and fan opening 22, respectively, into and through the housing interior 26. The air 98 may flow across the primary cooling conduits 64 and secondary cooling conduits 66 of the heat exchanger 46 and then exit the cooler housing 2 through the housing opening or openings 8 typically in the base rear panel 5 of the housing base 3.

Figure 15:
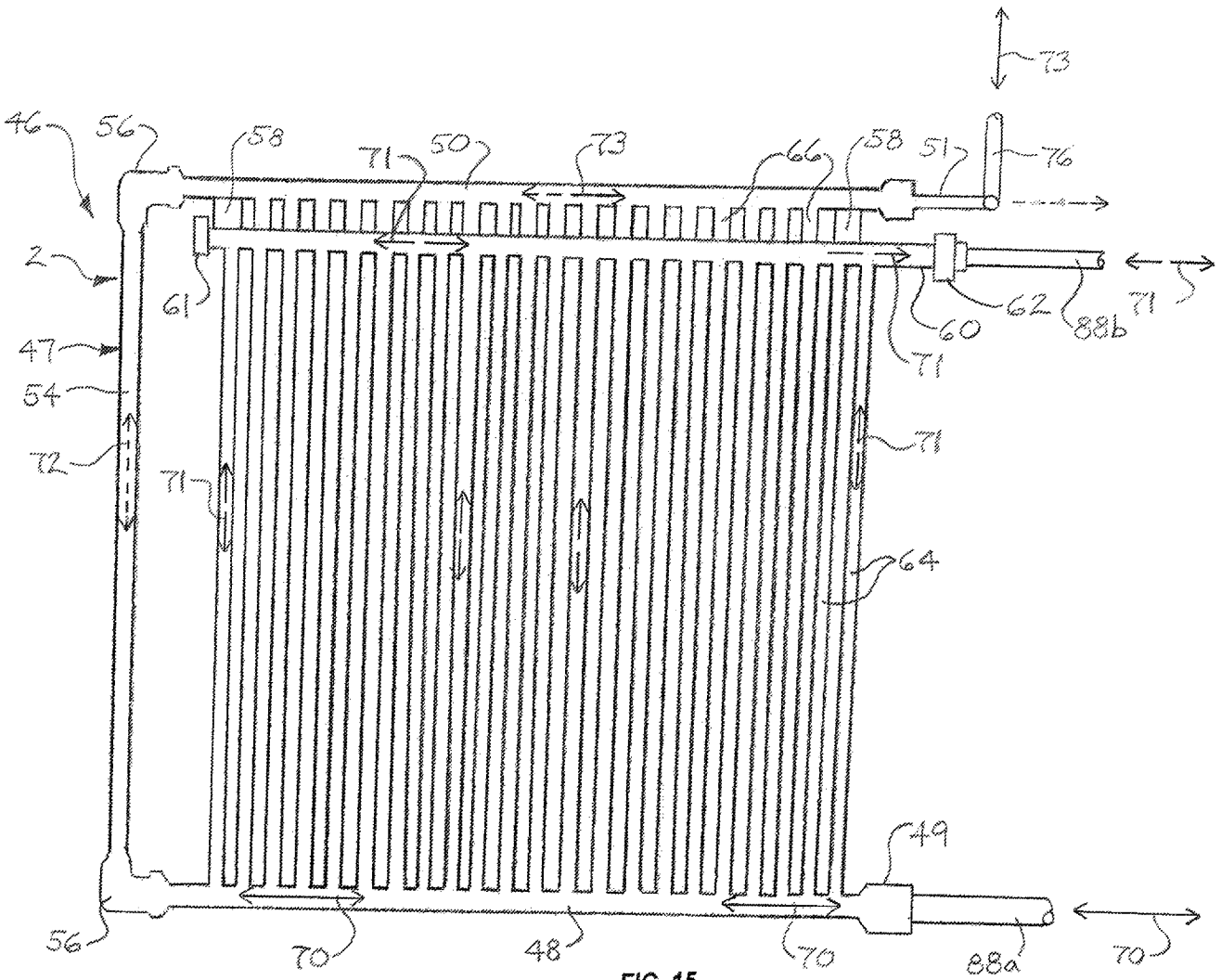
FIG. 15 is a sectional view of the heat exchanger, more particularly illustrating typical flow of hydraulic fluid through the heat exchanger in application of the hydraulic fluid cooler.
Figure 16:
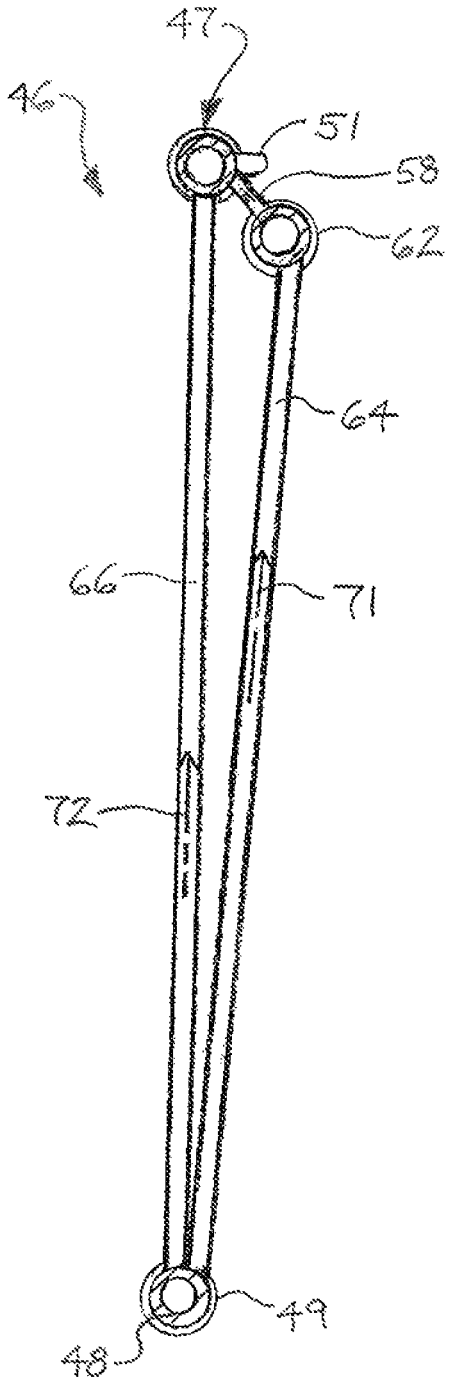
FIG. 16 is a cross-sectional view, taken along section lines 12-12 in FIG. 6, more particularly illustrating a typical flow of hydraulic fluid through the heat exchanger in application of the hydraulic fluid cooler.

As illustrated in FIGS. 15 and 17, the motor hydraulic fluid stream 70 in the inlet segment **88*a* of the motor actuating loop 88 may enter the header inlet conduit 48 of the header assembly 47 through the header inlet coupling 49. From the header inlet conduit 48, a return hydraulic fluid stream 71 may flow through the primary cooling conduits 64 to the header outlet conduit 60 of the header assembly 47. The return hydraulic fluid stream 71 may flow from the header outlet conduit 60 and back into and through the motor actuating loop 88 through the outlet segment 88*b*. Simultaneously, the fan motor hydraulic fluid stream 73 may flow from the motor hydraulic fluid stream 70 in the header inlet conduit 48 through the secondary cooling conduits 66 and into the fan motor outlet conduit 50 of the header assembly 47. The fan motor hydraulic fluid stream 73 may leave the fan motor outlet conduit 50 and enter the fan motor loop 76 (FIG. 17) through the hose fitting 51. As further illustrated in FIGS. 15 and 16, a residual hydraulic fluid stream 72 may flow from the header inlet conduit 48 through the connecting conduit 54 and into the fan motor outlet conduit 50 of the header assembly 47. The residual hydraulic fluid stream 72 may combine with the fan motor hydraulic fluid stream 73 and enter the fan motor loop 76 from the fan motor outlet conduit 50**.

As the return hydraulic fluid stream 71 and the fan motor hydraulic fluid stream 73 flow through the primary cooling conduits 64 and secondary cooling conduits 66, respectively, the cooler fan motor 40 may operate the cooling fan 42, which may draw air 98 from outside the cooler housing 2 into the housing interior 26 through the fan grill 44 and fan opening 22, as illustrated in FIG. 17. The air 98 in the housing interior 26 may flow into contact with and between the primary cooling conduits 64 and the secondary cooling conduits 66. The air 98 may then exit the housing interior 26 through the housing opening or openings 8 (FIG. 14) in the base rear panel 5 of the housing base 3.

As the air 98 contacts the primary cooling conduits 64 and the secondary cooling conduits 66, heat may be dissipated from the return hydraulic fluid stream 71 and the fan motor hydraulic fluid stream 73 through the walls of the primary cooling conduits 64 and secondary cooling conduits 66 into the flowing air 98. Accordingly, as it leaves the header outlet conduit 60 and enters the outlet segment 88*b* of the motor actuating loop 88, the return hydraulic fluid stream 71 may be in a cooled state. Similarly, as it leaves the fan motor outlet conduit 50 and enters the fan motor loop 76, the fan motor hydraulic fluid stream 73 may be in a cooled state.

Figure 18:
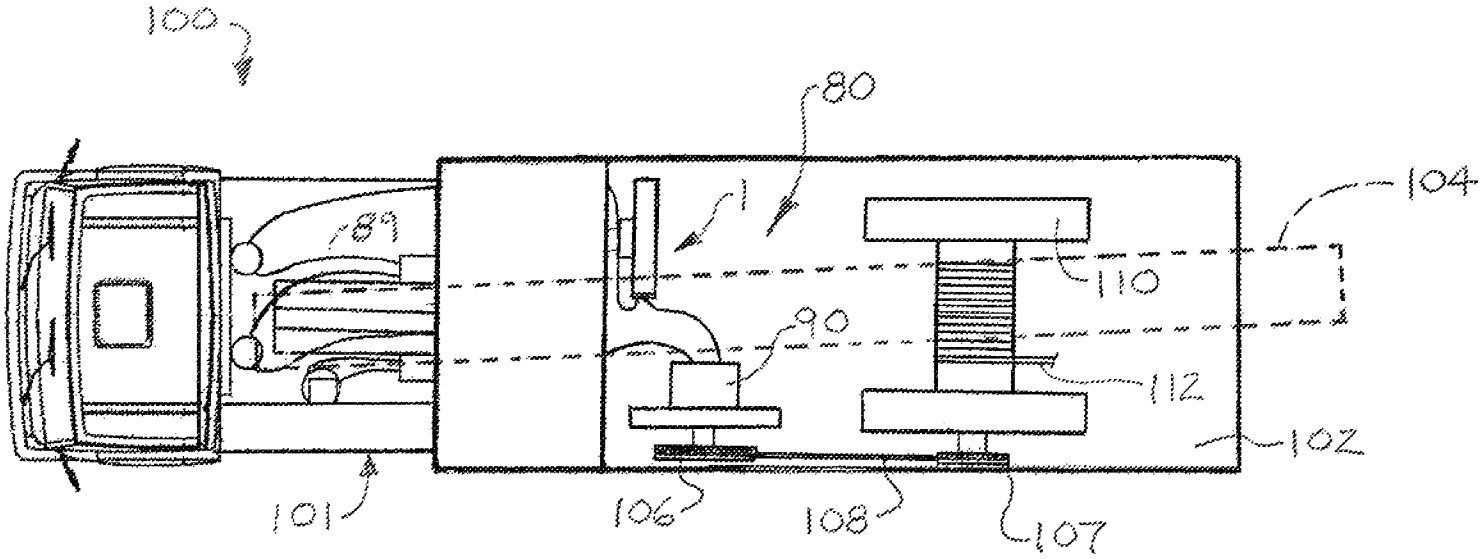
FIG. 18 is a top view of a typical swab unit with the hydraulic fluid cooler installed on the swab unit in typical application of the hydraulic fluid cooler.

Referring next to FIGS. 17 and 18 of the drawings, in typical application, the hydraulic fluid cooler 1 may be installed on a swab unit 100 to cool the motor hydraulic fluid stream 70 (FIG. 17) after the motor pump 89 pumps the motor hydraulic fluid stream 70 through the hydraulic motor 90 in the motor actuating loop 88. The swab unit 100 may be operated to remove well fluid from a wellbore of a hydrocarbon production well (not illustrated) to reduce the hydrostatic pressure and enhance production of hydrocarbon from the well. As illustrated in FIG. 18, the swab unit 100 may be conventional with a truck chassis 101. An elongated truck bed 102 may be provided on the truck chassis 101. An erectable mast 104 (illustrated in phantom) with sheaves or pulleys (not illustrated) may be provided on the truck chassis 101. The hydraulic motor 90 in the motor actuating loop 88 (FIG. 17) may be provided on the truck bed 102. The hydraulic motor 90 may drivingly engage a cable spool 110 which is mounted for rotation on the truck bed 102. A length of winch cable 112 may be wound on the cable spool 110. The winch cable 112 may be trained on the sheaves or pulleys on the mast 104. Swabbing tools and swab cups (not illustrated) may be secured to the extending or distal end of the winch cable 112 as is known by those skilled in the art. Accordingly, in some applications, the hydraulic motor 90 may drivingly engage a drive sprocket 106. An idle sprocket 107 may engage the cable spool 110. A drive chain 108 may transmit rotation from the drive sprocket 106 to the idle sprocket 107 responsive to operation of the hydraulic motor 90. In alternative applications, a gear train, direct hydraulic drive and/or other drive mechanism (not illustrated) may be used to transmit rotation from the hydraulic motor 90 to the cable spool 110.

The closed loop hydraulic system 80 may be operated to actuate the various hydraulic components on the swab unit 100 and/or on the winch cable 112 as is known by those skilled in the art. Accordingly, in some applications, the system hydraulic fluid 68 in the main loop 86 may operate tools, hydraulic motors(s) and/or other components and/or perform other functions in the wellbore as is known by those skilled in the art. Thus, as it traverses from the hydraulic reservoir 81 through the valve bank 83 and back to the system cooler 84 and system filter 85, respectively, to the hydraulic reservoir 81, the main loop 86 may extend into and exit from the wellbore for various purposes. The pressure of the system hydraulic fluid 68 in the main loop 86 may be lower entering the wellbore and higher exiting the wellbore. In some applications, the motor actuating loop 88 may be provided on the lower-pressure side of the main loop 86 and operate at the predetermined hydraulic fluid charge pressure.

As the system hydraulic fluid 68 circulates through the main loop 86, the motor pump 89 in the motor actuating loop 88 may pump the motor hydraulic fluid stream 70 through the hydraulic motor 90 to operate the hydraulic motor 90 in either direction. The hydraulic motor 90 may facilitate rotation of the cable spool 110 in either direction to unwind the winch cable 112 from or wind the winch cable 112 on the cable spool 110. In some applications, the motor pump 89 may include a charge pump (not illustrated) which maintains the motor hydraulic fluid stream 70 at the predetermined hydraulic fluid charge pressure.

In typical operation of the swab unit 100, a swab unit operator (not illustrated) may drive the swab unit 100 to the well which is to be swabbed or serviced. The swab unit operator may raise the mast 104 from the stowage position on the truck chassis 101 to the functional position and align the mast 104 with the centerline of the well. By operation of the hydraulic motor 90, the swab unit operator may lower the swabbing tools attached to the winch cable 112 by unwinding the winch cable 112 from the cable spool 110. This may be accomplished by operation of the motor pump 89 and hydraulic motor 90 in a first direction to facilitate flow of the motor hydraulic fluid 70 in the corresponding direction through the motor actuating loop 88. The swab tools on the winch cable 112 may support swab cups (not illustrated). The swab tools may facilitate flow of fluids up through and above the swab cups.

Upon completion of the swabbing operation, the swab unit operator may operate the hydraulic motor 90 to raise the swabbing tools and swab cups attached to the winch cable 112 by winding the winch cable 112 on the cable spool 110. This may be accomplished by reverse operation of the motor pump 89 and hydraulic motor 90 in a second direction to facilitate flow of the motor hydraulic fluid 70 in the opposite direction through the motor actuating loop 88. The swab cups may lift a column of fluids from the well, lowering the downhole hydrostatic pressure of the well and enhancing hydrocarbon production. The mast 104 may then be lowered back into the stowage position on the truck chassis 101 and the swab unit 100 driven away from the well.

As illustrated in FIG. 17, by operation of the system pump 82, the system hydraulic fluid 68 may be circulated from the hydraulic fluid reservoir 81 through the main loop 86. Thus, the system pump 82 may pump the system hydraulic fluid 68 from the hydraulic fluid reservoir 81 through the valve bank 83, the system cooler 84 and the system filter 85 and back to the hydraulic fluid reservoir 81. The valve bank 83 may be used to operate the various hydraulic components on the swab unit 100 and/or on the winch cable 112, as is known by those skilled in the art. Simultaneously, the motor pump 89 may pump the motor hydraulic fluid stream 70 from the hydraulic fluid reservoir 81 through the motor actuating loop 88. Accordingly, the motor hydraulic fluid stream 70 may flow through the hydraulic motor 90, which may perform the designated operation such as rotating the cable spool 110 on the swab unit 100 (FIG. 18), for example and without limitation, as was heretofore described.

As the motor pump 89 pumps the motor hydraulic fluid stream 70 through the hydraulic motor 90, the motor hydraulic fluid stream 70 may be subject to frictional forces which significantly heat the hydraulic fluid. The heated hydraulic fluid in the motor hydraulic fluid stream 70 may potentially compromise the structural and/or functional integrity of the hydraulic hoses and/or the motor pump 89, hydraulic motor 90 and/or other components in the motor actuating loop 88. Accordingly, the motor hydraulic fluid stream 70 may be routed through the hydraulic fluid cooler 1 which may cool the motor hydraulic fluid stream 70 before it continues back to the motor pump 89 and the hydraulic motor 90 for another circulation cycle through the motor actuating loop 88. The motor hydraulic fluid stream 70 may flow from the hydraulic motor 90 into the header inlet conduit 48 (FIG. 15) in the header assembly 47 of the heat exchanger 46 in the hydraulic fluid cooler 1 through the inlet segment 88*a* of the motor actuating loop 88. In the heat exchanger 46, the return hydraulic fluid stream 71 may flow through the primary cooling conduits 64 and the header outlet conduit 60, respectively, and re-enter the motor actuating loop 88 through the outlet segment 88*b*, as illustrated in FIG. 15. Simultaneously, the fan motor hydraulic fluid stream 73 may flow from the motor hydraulic fluid stream 70 through the secondary cooling conduits 66 and into the fan motor outlet conduit 50, respectively. The fan motor hydraulic fluid stream 73 may enter the fan motor loop 76 from the fan motor outlet conduit 50, typically through the hose fitting 51. Accordingly, the fan motor hydraulic fluid stream 73 may flow through the cooler outlet valve 92, the fan motor valve 93 and the cooler fan motor 40, respectively, of the fan motor loop 76. As it flows through the cooler fan motor 40, the fan motor hydraulic fluid stream 73 may actuate the cooler fan motor 40 to rotate the cooling fan 42 in the housing interior 26 of the cooler housing 2. The rotating cooling fan 42 may draw the air 98 into and through the housing interior 26 and across the primary cooling conduits 64 and secondary cooling conduits 66, cooling the return hydraulic fluid stream 71 and fan motor hydraulic fluid stream 73, respectively, as well as heretofore described. In reverse operation of the motor pump 89 and hydraulic motor 90, the motor hydraulic fluid stream 70 may flow in the opposite direction through the heat exchanger 46.

As the fan motor hydraulic fluid stream 73 flows through the fan motor loop 76, the pressure switch 94 may continually monitor the pressure of the fan motor hydraulic fluid stream 73 in the fan motor valve 93. In the event that the measured pressure of the fan motor hydraulic fluid stream 73 exceeds the predetermined hydraulic fluid charge pressure, the pressure switch 94 may close the fan motor valve 93. Accordingly, the fan motor hydraulic fluid stream 73 may be incapable of continuing flow through the remaining segment of the fan motor loop 76 and the cooling fan motor 40, respectively, to prevent inadvertent overspeed of and damage to the cooling fan motor 40. Corrective measures may then be undertaken to return the fluid pressure of the fan motor hydraulic fluid stream 73 back to within operating parameters.

In applications in which the cooling fan motor 40 includes a DC or AC electric motor, the fan motor loop 76 may bypass the cooler fan motor 40 and terminate at the system cooler 84. The pressure switch 94 may functionally interface with the cooler fan motor 40 to terminate further operation of the cooler fan motor 40 in the event that the measured pressure of the fan motor hydraulic fluid stream 73 exceeds the predetermined hydraulic fluid charge pressure.

It will be appreciated by those skilled in the art that the hydraulic fluid cooler 1 is capable of withstanding hydraulic pressures in excess of 300-500 psi which may be characteristic of hydraulic fluid in a closed loop hydraulic fluid system used on swab units and other applications. Moreover, the hydraulic fluid cooler 1 may have the capability to terminate further flow of hydraulic fluid to the cooler fan motor 40 in the event that the pressure switch 94 measures a hydraulic fluid pressure which exceeds the predetermined hydraulic fluid charge pressure at the fan motor valve 93. By removing the motor hydraulic fluid stream 70 from the hydraulic fluid reservoir 81 in the main loop 86, the hydraulic fluid cooler 1 may help remove any cavitation that may form in the system hydraulic fluid 68 as it enters the wellbore. It will be recognized and understood that the hydraulic fluid cooler 1 is amenable to a variety of uses including but not limited to rotating a cable spool on a swab unit.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A hydraulic fluid cooler for a closed loop hydraulic system including a main loop having a hydraulic fluid reservoir, a system pump disposed in fluid communication with the hydraulic fluid reservoir and a motor actuating loop including a motor pump provided in fluid communication with the hydraulic fluid reservoir, the hydraulic fluid cooler comprising:

at least one heat exchanger, the at least one heat exchanger including:

a header assembly having:

a header inlet conduit configured for placement in fluid communication with the motor actuating loop;

a header outlet conduit configured for placement in fluid communication with the motor actuating loop; and a fan motor outlet conduit;

a plurality of primary cooling conduits disposed in fluid communication with and extending between the header inlet conduit and the header outlet conduit;

a plurality of secondary cooling conduits disposed in fluid communication with and extending between the header inlet conduit and the fan motor outlet conduit;

each of the header inlet conduit, the fan motor outlet conduit, the header outlet conduit, the primary cooling conduit and the secondary cooling conduits is fabricated of 316L stainless steel schedule 80 pipe, whereby the at least one heat exchanger is capable of withstanding hydraulic pressures of greater than 300-500 psi;

a cooling fan disposed adjacent to the plurality of primary cooling conduits and the plurality of secondary cooling conduits; and a cooling fan motor drivingly engaging the cooling fan.

2. The hydraulic fluid cooler of claim 1 wherein the cooling fan motor comprises a hydraulically-actuated cooling fan motor, and the cooling fan motor is disposed in fluid communication with the fan motor outlet conduit of the header assembly.

3. The hydraulic fluid cooler of claim 1 further comprising a fan motor valve disposed in fluid communication with and between the fan motor outlet conduit of the header assembly and the cooling fan motor and a pressure switch interfacing with the fan motor valve, the pressure switch configured to measure pressure of hydraulic fluid from the fan motor outlet conduit, and wherein the fan motor valve is configured to terminate operation of the cooling fan motor responsive to input from the pressure switch when the pressure of the hydraulic fluid exceeds a predetermined hydraulic fluid charge pressure.

4. The hydraulic fluid cooler of claim 3 wherein the fan motor valve is configured to terminate operation of the cooling fan motor when the predetermined hydraulic fluid charge pressure is at least about 300-500 psi.

5. The hydraulic fluid cooler of claim 1 further comprising at least one conduit connector mounting the header outlet conduit to the fan motor outlet conduit.

6. The hydraulic fluid cooler of claim 1 wherein the header assembly further comprises a connecting conduit establishing fluid communication between the header inlet conduit and the fan motor outlet conduit.

7. The hydraulic fluid cooler of claim 1 wherein the plurality of primary cooling conduits is disposed out-of-plane with respect to the header inlet conduit and the fan motor outlet conduit and the plurality of secondary cooling conduits is disposed in-plane with respect to the header inlet conduit and the fan motor outlet conduit.

8. A hydraulic fluid cooler, comprising:

at least one heat exchanger, the at least one heat exchanger including:

a header assembly having:

a header inlet conduit;

a header outlet conduit; and a fan motor outlet conduit;

a plurality of primary cooling conduits disposed in fluid communication with and extending between the header inlet conduit and the header outlet conduit;

a plurality of secondary cooling conduits disposed in fluid communication with and extending between the header inlet conduit and the fan motor outlet conduit;

a cooling fan disposed adjacent to the plurality of primary cooling conduits and the plurality of secondary cooling conduits; and a cooling fan motor drivingly engaging the cooling fan; and a cooler outlet valve disposed in fluid communication with and between the fan motor outlet conduit of the header assembly and the fan motor valve.

9. A hydraulic fluid cooler for a closed loop hydraulic system including a main loop having a hydraulic fluid reservoir, a system pump disposed in fluid communication with the hydraulic fluid reservoir and a motor actuating loop including a motor pump provided in fluid communication with the hydraulic fluid reservoir, the hydraulic fluid reservoir, the hydraulic fluid cooler comprising:

a cooler housing having a housing interior;

a fan opening in the cooler housing;

at least one housing opening in the cooler housing opposite the fan opening;

at least one heat exchanger in the housing interior, the at least one heat exchanger including:

a header assembly having:

a header inlet conduit configured for placement in fluid communication with the motor actuating loop;

a header outlet conduit configured for placement in fluid communication with the motor actuating loop and disposed within a first horizontal plane; and a fan motor outlet conduit disposed within a second horizontal plane above the first horizontal plane;

a plurality of primary cooling conduits disposed in fluid communication with and extending between the header inlet conduit and the header outlet conduit; and a plurality of secondary cooling conduits disposed in fluid communication with and extending between the header inlet conduit and the fan motor outlet conduit, the plurality of primary cooling conduits is disposed out-of-plane with respect to the header inlet conduit and the fan motor outlet conduit and the plurality of secondary cooling conduits is disposed in-plane with respect to the header inlet conduit and the fan motor outlet conduit;

each of the header inlet conduit, the fan motor outlet conduit, the header outlet conduit, the primary cooling conduits and the secondary cooling conduits is fabricated of 316L stainless steel schedule 80 pipe, whereby the at least one heat exchanger is capable of withstanding hydraulic pressures of greater than 300-500 psi;

a cooling fan disposed in the housing interior of the cooler housing adjacent to the plurality of primary cooling conduits and the plurality of secondary cooling conduits of the at least one heat exchanger; and a hydraulically-actuated cooling fan motor drivingly engaging the cooling fan and disposed in fluid communication with the fan motor outlet conduit of the header assembly.

10. The hydraulic fluid cooler of claim 9 further comprising a fan motor valve disposed in fluid communication with and between the fan motor outlet conduit of the header assembly and the cooling fan motor and a pressure switch interfacing with the fan motor valve, the pressure switch configured to measure pressure of hydraulic fluid from the fan motor outlet conduit, and wherein the fan motor valve is configured to terminate fluid communication between the fan motor outlet conduit and the cooling fan motor responsive to input from the pressure switch when the pressure of the hydraulic fluid exceeds a predetermined hydraulic fluid charge pressure.

11. The hydraulic fluid cooler of claim 10 wherein the fan motor valve is configured to terminate the fluid communication between the fan motor outlet conduit and the cooling fan motor when the predetermined hydraulic fluid charge pressure is at least 300-500 psi.

12. The hydraulic fluid cooler of claim 10 further comprising a cooler outlet valve disposed in fluid communication with and between the fan motor outlet conduit of the header assembly and the fan motor valve.

13. The hydraulic fluid cooler of claim 12 wherein the cooler outlet valve is an orifice valve or a needle valve.

14. The hydraulic fluid cooler of claim 9 further comprising at least one conduit connector mounting the header outlet conduit to the fan motor outlet conduit.

15. The hydraulic fluid cooler of claim 9 wherein the header assembly further comprises a connecting conduit establishing fluid communication between the header inlet conduit and the fan motor outlet conduit.

16. The hydraulic fluid cooler of claim 9 further comprising a fan motor pedestal carried by the cooler housing exterior to the housing interior and adjacent to the fan opening, and wherein the cooling fan motor is carried by the fan motor pedestal.

17. A hydraulic fluid cooler for a closed loop hydraulic system including a main loop having a hydraulic fluid reservoir, a system pump disposed in fluid communication with the hydraulic fluid reservoir and a motor actuating loop including a motor pump provided in fluid communication with the hydraulic fluid reservoir, the hydraulic fluid reservoir, comprising:

a cooler housing having a housing interior;

a fan opening in the cooler housing;

at least one housing opening in the cooler housing opposite the fan opening;

a fan motor pedestal carried by the cooler housing exterior to the housing interior and adjacent to the fan opening;

at least one heat exchanger in the housing interior, the at least one heat exchanger including:

a header assembly having:

a header inlet conduit configured for placement in fluid communication with the motor actuating loop;

a connecting conduit disposed in fluid communication with the header inlet conduit;

a fan motor outlet conduit disposed in fluid communication with the connecting conduit; and a header outlet conduit configured for placement in fluid communication with the motor actuating loop, the header outlet conduit vertically offset with respect to the fan motor outlet conduit, the header outlet conduit disposed in a first horizontal plane and the fan motor outlet conduit disposed in a second horizontal plane above the first horizontal plane;

a plurality of primary cooling conduits disposed in fluid communication with and extending between the header inlet conduit and the header outlet conduit;

a plurality of secondary cooling conduits disposed in fluid communication with and extending between the header inlet conduit and the fan motor outlet conduit, the plurality of primary cooling conduits is disposed out-of-plane with respect to the header inlet conduit, the connecting conduit and the fan motor outlet conduit and the plurality of secondary cooling conduits is disposed in-plane with respect to the header inlet conduit, the connecting conduit and the fan motor outlet conduit;

each of the header inlet conduit, the connecting conduit, the fan motor outlet conduit, the header outlet conduit, the primary cooling conduits and the secondary cooling conduits is fabricated of 316L stainless steel schedule 80 pipe, whereby the at least one heat exchanger is capable of withstanding hydraulic pressures of greater than 300-500 psi;

a cooling fan disposed in the housing interior of the cooler housing adjacent to the plurality of primary cooling conduits and the plurality of secondary cooling conduits of the at least one heat exchanger;

a hydraulically-actuated cooling fan motor carried by the fan motor pedestal, the cooling fan motor drivingly engaging the cooling fan and disposed in fluid communication with the fan motor outlet conduit;

a fan motor valve disposed in fluid communication with and between the fan motor outlet conduit of the header assembly and the cooling fan motor; and a pressure switch interfacing with the fan motor valve, the pressure switch configured to measure pressure of hydraulic fluid from the fan motor outlet conduit, and wherein the fan motor valve is configured to terminate fluid communication between the fan motor outlet conduit and the cooling fan motor responsive to input from the pressure switch when the pressure of the hydraulic fluid exceeds a predetermined hydraulic fluid charge pressure.

18. The hydraulic fluid cooler of claim 17 further comprising a cooler outlet valve disposed in fluid communication with and between the fan motor outlet conduit of the header assembly and the fan motor valve.

19. The hydraulic fluid cooler of claim 18 wherein the cooler outlet valve is an orifice valve or a needle valve.

20. The hydraulic fluid cooler of claim 17 further comprising at least one conduit connector mounting the header outlet conduit to the fan motor outlet conduit.

* * * * *